US011761131B2

(12) United States Patent
Bentley

(10) Patent No.: US 11,761,131 B2
(45) Date of Patent: Sep. 19, 2023

(54) RIBBON ENCODER FOR SEWING MACHINE STITCH REGULATION

(71) Applicant: Arthur L Bentley, Draper, UT (US)

(72) Inventor: Arthur L Bentley, Draper, UT (US)

( * ) Notice: Subject to any disclaimer, the term of this patent is extended or adjusted under 35 U.S.C. 154(b) by 117 days.

(21) Appl. No.: 17/472,462

(22) Filed: Sep. 10, 2021

(65) Prior Publication Data

US 2022/0081816 A1 Mar. 17, 2022

Related U.S. Application Data

(60) Provisional application No. 63/077,535, filed on Sep. 11, 2020.

(51) Int. Cl.
*D05B 19/12* (2006.01)
*D05B 69/12* (2006.01)
*D05B 69/18* (2006.01)

(52) U.S. Cl.
CPC ..... *D05B 19/12* (2013.01); *D05B 69/12* (2013.01); *D05B 69/18* (2013.01)

(58) Field of Classification Search
CPC ..... D05B 19/00–16; D05B 69/00–30; D05B 11/00
See application file for complete search history.

(56) References Cited

U.S. PATENT DOCUMENTS 2,597,686 A 5/1952 Turner et al.
D232,265 S 7/1974 Laidig
4,072,114 A 2/1978 Sugiyama et al.
4,192,243 A 3/1980 Blessing
4,221,317 A 9/1980 Fukada
D268,113 S 3/1983 Johnson et al.
4,408,554 A 10/1983 Takiguchi
4,419,945 A 12/1983 Nishina
D284,578 S 7/1986 Yoneda
4,648,341 A 3/1987 Kato et al.
4,649,844 A 3/1987 Matsubara
4,766,827 A 8/1988 Matsubara
4,998,489 A 3/1991 Hisatake et al.
5,005,500 A 4/1991 Kato et al.
5,095,835 A 3/1992 Jernigan et al.
5,167,194 A 12/1992 Nakagaki
5,315,945 A 5/1994 Nakano
5,319,566 A 6/1994 Kongho et al.
5,323,722 A 6/1994 Goto et al.
D361,773 S 8/1995 Jimenez
5,471,941 A 12/1995 Sakuma
5,711,236 A 1/1998 Badger
6,012,405 A 1/2000 Melton
6,792,884 B1 * 9/2004 Barrus ..... D05B 39/005 112/475.08
6,823,807 B2 11/2004 Zesch
6,860,211 B2 3/2005 Valeriote et al.
6,883,446 B2 4/2005 Koerner
6,932,007 B1 8/2005 Beauchamp
(Continued)

*Primary Examiner* — Ismael Izaguirre
(74) *Attorney, Agent, or Firm* — PETERSON IP; Brett Peterson

(57) ABSTRACT

A sewing machine system includes an optical encoder which senses relative movement between the sewing machine and fabric and varies the stitching speed of the sewing machine to create stitches according to a user selected stitch length.

12 Claims, 15 Drawing Sheets

(56) References Cited

U.S. PATENT DOCUMENTS

| | | | | |
|---|---|---|---|---|
| 6,959,657 | B1 * | 11/2005 | Duval | D05B 19/14 112/272 |
| 6,990,914 | B2 | 1/2006 | Canan | |
| 7,210,417 | B2 | 5/2007 | Koerner | |
| 7,325,502 | B2 | 2/2008 | Konig | |
| 7,373,891 | B2 | 5/2008 | Koerner | |
| 7,386,361 | B2 | 6/2008 | Nobuyuki | |
| D590,849 | S | 4/2009 | Muller et al. | |
| 7,793,602 | B2 | 9/2010 | Koerner | |
| 7,854,207 | B2 | 12/2010 | Kuki | |
| 8,037,834 | B2 | 10/2011 | Shimizu | |
| 8,074,590 | B2 | 12/2011 | Bentley | |
| 8,146,522 | B2 | 4/2012 | Lee et al. | |
| 8,528,491 | B2 | 9/2013 | Bentley | |
| D694,783 | S | 12/2013 | Bentley | |
| D694,785 | S | 12/2013 | Bentley | |
| D694,786 | S | 12/2013 | Bentley | |
| 8,606,390 | B2 | 12/2013 | Hjalmarsson | |
| 8,960,112 | B2 | 2/2015 | Brindzik | |
| 8,985,038 | B2 | 3/2015 | Flygare | |
| 9,115,451 | B2 | 8/2015 | Konzak | |
| 9,394,640 | B2 | 7/2016 | Bentley | |
| 2003/0188675 | A1 | 10/2003 | Valeriote et al. | |
| 2005/0045083 | A1 * | 3/2005 | Canan | D05B 11/00 112/117 |
| 2005/0145149 | A1 | 7/2005 | Hooke | |
| 2006/0112866 | A1 * | 6/2006 | Pfeifer | D05B 11/00 112/117 |
| 2007/0005175 | A1 | 1/2007 | Konig et al. | |
| 2007/0221108 | A1 | 9/2007 | Koerner | |
| 2008/0229991 | A1 | 9/2008 | Makino | |
| 2013/0276686 | A1 | 10/2013 | Bentley | |
| 2016/0319473 | A1 * | 11/2016 | Schwarzberger | D05B 19/08 |
| 2019/0292702 | A1 * | 9/2019 | Konzak | D05B 19/12 |

* cited by examiner

RIBBON ENCODER FOR SEWING MACHINE STITCH REGULATION

PRIORITY

The present application claims the benefit of U.S. Provisional Application Ser. No. 63/077,535, filed Sep. 11, 2020, which is herein incorporated by reference in its entirety.

THE FIELD OF THE INVENTION

The present invention relates to sewing machines. In particular, examples of the present invention relate to a system for monitoring movement of cloth relative to a sewing machine while sewing and regulating the stitching speed of the sewing machine according to the cloth movement to regulate the sewing machine stitch length.

BACKGROUND

Numerous systems exist for allowing a person to quilt with a sewing machine. These systems allow a user to move one of the sewing machine or fabric relative to the other and stitch freehand patterns into the fabric. Some of these systems track the movement of the fabric relative to the sewing machine and adjust the speed of the sewing machine according to the fabric movement to regulate the stitch length. These systems often suffer from inaccuracy during use and fail to deliver the desired performance.

BRIEF DESCRIPTION OF THE DRAWINGS

Non-limiting and non-exhaustive examples of the present invention are described with reference to the following figures, wherein like reference numerals refer to like parts throughout the various views unless otherwise specified.

Figure 1:
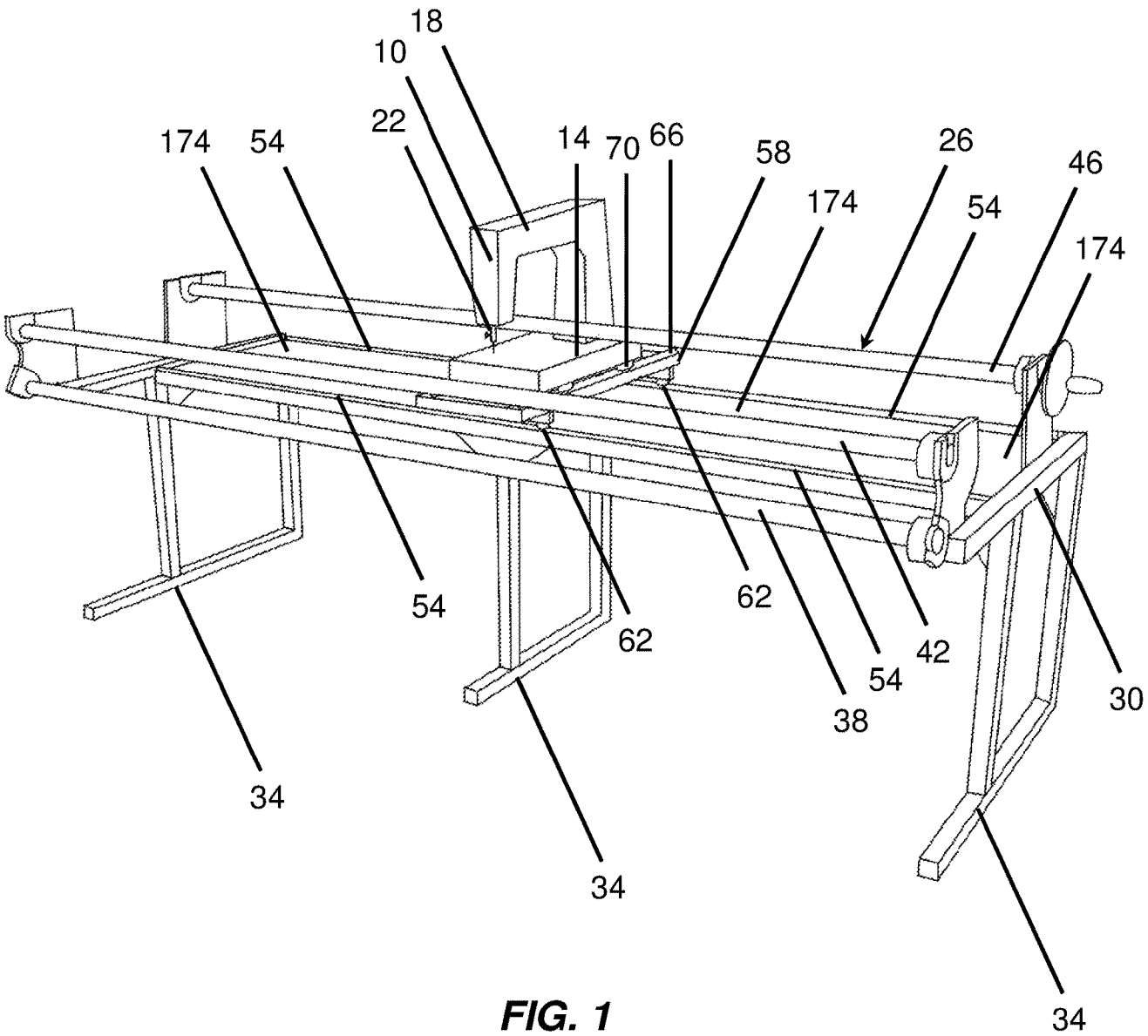
FIG. 1 is a perspective view drawing of a sewing machine and quilting frame.

Corresponding reference characters indicate corresponding components throughout the several views of the drawings. Unless otherwise noted, the drawings have been drawn to scale. Skilled artisans will appreciate that elements in the figures are illustrated for simplicity and clarity. For example, the dimensions of some of the elements in the figures may be exaggerated relative to other elements to help improve understanding of various examples of the present invention. Also, common but well-understood elements that are useful or necessary in a commercially feasible embodiment are often not depicted in order to facilitate a less obstructed view of these various embodiments of the present invention.

It will be appreciated that the drawings are illustrative and not limiting of the scope of the invention which is defined by the appended claims. The examples shown each accomplish various different advantages. It is appreciated that it is not possible to clearly show each element or advantage in a single figure, and as such, multiple figures are presented to separately illustrate the various details of the examples in greater clarity. Similarly, not every example need accomplish all advantages of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

In the above disclosure, reference has been made to the accompanying drawings, which form a part hereof, and in which are shown by way of illustration specific implementations in which the disclosure may be practiced. It is understood that other implementations may be utilized and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, such feature, structure, or characteristic may be used in connection with other embodiments whether or not explicitly described. The particular features, structures or characteristics may be combined in any suitable combination and/or sub-combinations in one or more embodiments or examples. It is appreciated that the figures provided herewith are for explanation purposes to persons ordinarily skilled in the art.

Implementations of the systems, devices, and methods disclosed herein may comprise or utilize a special purpose or general-purpose computer including computer hardware, such as, for example, one or more processors and system memory, as discussed herein. Implementations within the scope of the present disclosure may also include physical and other computer-readable media for carrying or storing computer-executable instructions and/or data structures. Such computer-readable media can be any available media that can be accessed by a general purpose or special purpose computer system. Computer-readable media that store computer-executable instructions are computer storage media (devices). Computer-readable media that carry computer-executable instructions are transmission media. Thus, by way of example, and not limitation, implementations of the disclosure can comprise at least two distinctly different kinds of computer-readable media: computer storage media (devices) and transmission media.

Computer storage media (devices) includes RAM, ROM, EEPROM, CD-ROM, solid state drives ("SSDs") (e.g., based on RAM), Flash memory, phase-change memory ("PCM"), other types of memory, other optical disk storage, magnetic disk storage or other magnetic storage devices, or any other medium which can be used to store desired program code means in the form of computer-executable instructions or data structures and which can be accessed by a general purpose or special purpose computer.

The flowchart and block diagrams in the flow diagrams illustrate the architecture, functionality, and operation of possible implementations of systems, methods, and computer program products according to various embodiments of the present invention. In this regard, each block in the flowchart or block diagrams may represent a module, segment, or portion of code, which comprises one or more executable instructions for implementing the specified logical function(s). It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions. These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

As used herein, "adjacent" refers to near or close sufficient to achieve a desired effect. Although direct contact is common, adjacent can broadly allow for spaced apart features.

As used herein, the singular forms "a," and, "the" include plural referents unless the context clearly dictates otherwise.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be such as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a number or numerical range endpoint by providing that a given value may be "a little above" or "a little below" the number or endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Dimensions, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

The disclosure particularly describes an improved encoder for a sewing machine quilting system. The encoder provides reliable movement information and allows for improved regulation of the sewing machine stitching speed. The encoder is less susceptible to lint and debris encountered during sewing.

Many people use sewing machines to perform freehand sewing of patterns on cloth. For example, people often create quilts by making a top and bottom fabric layer, stacking these with a middle layer of batting, and sewing through the stacked layers to hold them together. The act of sewing through the top layer, batting, and bottom layer of a quilt to stitch them together is referred to as quilting. When quilting, it is common to either stitch along a pattern in the top layer or to sew freeform patterns such as swirls, flowers, etc. Quilts with a top layer that has been pieced together from smaller pieces of fabric in a pattern are often quilted by sewing along seam lines in the top layer of the quilt. Quilts with a top layer which is printed are often quilted by sewing along printed designs in the fabric or by sewing freeform patterns.

While quilting, the sewing machine operator will typically vary the sewing speed significantly. It is quite difficult to maintain a consistent sewing speed while quilting a pattern or patchwork seam line because of the need to navigate the varying curves and corners in the pattern or seam. In order to facilitate better quilting, a frame is used to hold the fabric. For larger items such as a bed quilt, the frame can be quite large and the sewing machine is mounted to the frame on rails. An operator moves the sewing machine left/right and forwards/backwards on the rails while the quilt is held stationary. In order to create better stitches while quilting, relative movement between the sewing machine and the fabric is monitored and the speed of the sewing machine stitching motor is varied according to the movement; typically with the goal of creating a relatively uniform stitch length while the operator speed in quilting along a desired pattern varies.

Figure 2:
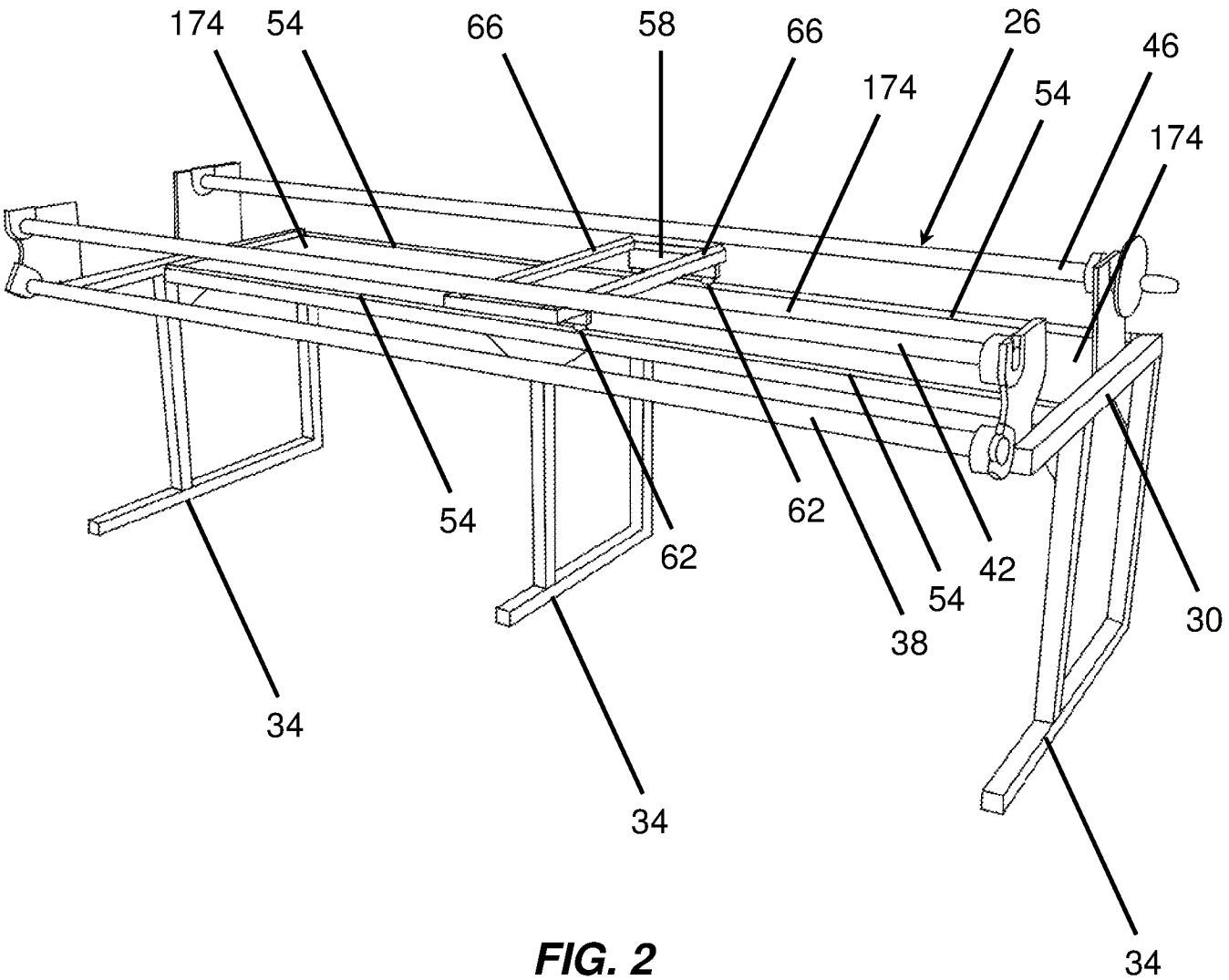
FIG. 2 is a perspective view drawing of the quilting frame.

Turning now to FIG. 1, a perspective view of a quilting system is shown. FIG. 2 shows a similar perspective view of the quilting system without the sewing machine attached to better illustrate parts of the quilting frame. The quilting system includes a sewing machine 10. The sewing machine 10 includes a bed/base 14 and an arm 18 which extends forwards above the base. The sewing head 22 is located at the front of the arm 18 and includes the sewing needle. A throat space between the arm 18 and the base 14 allows fabric to move into the throat as a person uses the sewing machine to stitch the fabric. Internally, the sewing machine 10 includes a motor and drivetrain which operates the sewing head and lower shuttle as well as a control which allows a user to set the speed of the motor and the resultant stitching speed.

The sewing machine 10 is attached to a quilting frame 26. The quilting frame 26 includes a frame body 30 with legs 34 that support the quilting frame 26, the sewing machine 10, and the sewing fabric. A quilt top rail 38 is mounted to the lower front of the quilting frame 26. Quilt top fabric is wound onto the quilt top rail 38 during use. A backing rail 42 is mounted to the upper front of the quilting frame 26. A quilt backing fabric is wound onto the backing rail 42. A take up rail 46 is attached to the upper back of the quilting frame 26.

Figure 3:
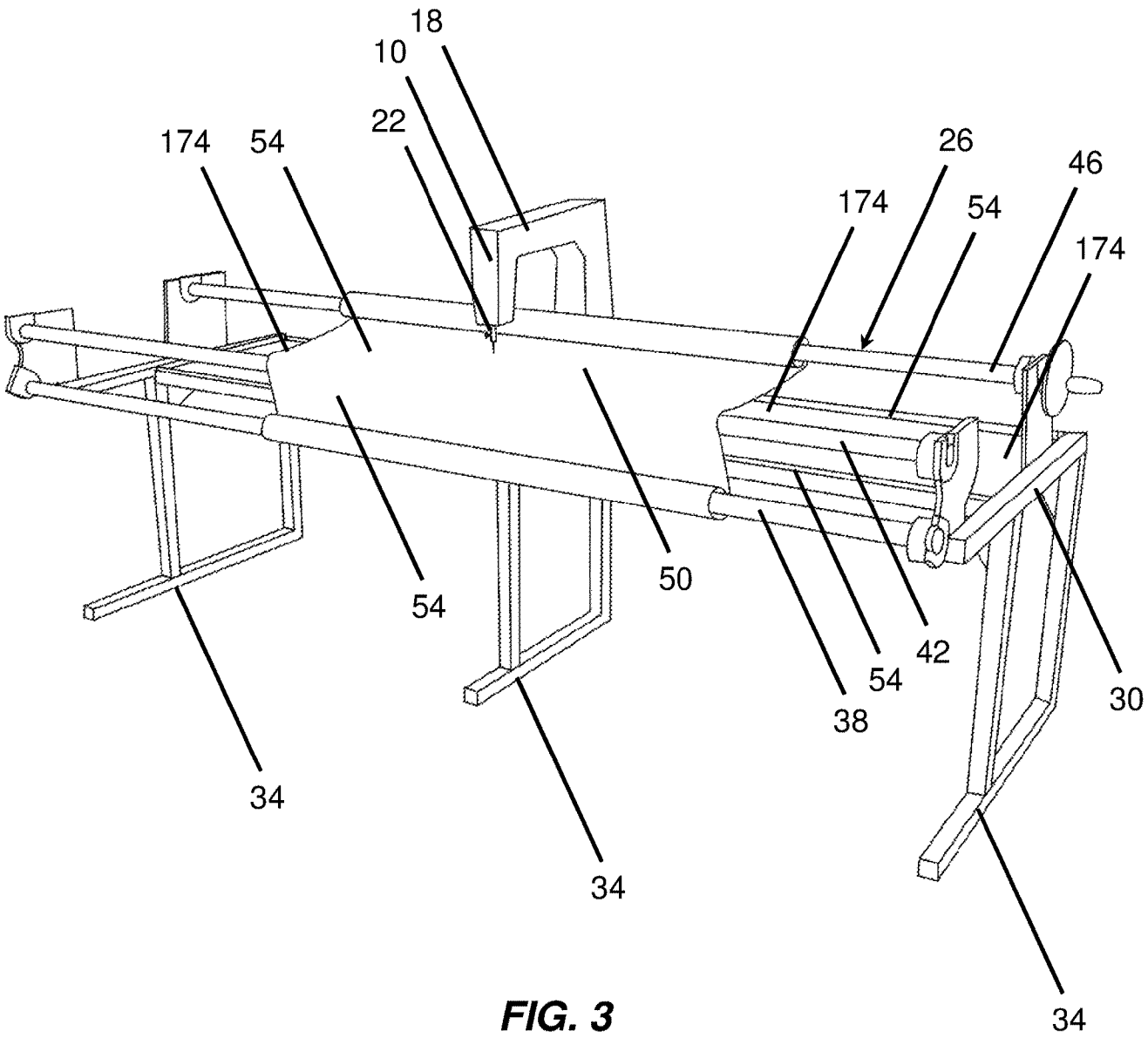
FIG. 3 is a perspective view drawing of the sewing machine and quilting frame.

In order to use the sewing machine 10 and quilting frame 26, strips of leader cloth are attached to the take up rail 46, quilt top rail 38, and backing rail 42. The leader cloth is about 10 inches wide and extends across the length of these rails. The fabric layers for a quilt can be attached to the leader cloth with pins to mount the fabric to the quilting frame 26. The back edge of the quilt backing cloth is pinned to the leader cloth on the take up rail 46 and the front edge of the quilt backing cloth is attached to the leader cloth on the backing rail 42. The quilt back fabric is then rolled onto the backing rail 42, stretching the quilt back fabric between the take up rail 46 and the backing rail 42. Quilt batting is then placed across the backing fabric and attached to the edge of the leader cloth or backing fabric at the take up rail 46 with pins or stitches. Quilt top fabric is placed across the quilt backing cloth and batting and the edge of the quilt top is attached to the edge of the leader cloth or to the backing and batting at the take up rail 46. The opposite edge of the quilt top fabric may be attached to the leader cloth on the quilt top rail 38 and the quilt top may be rolled onto the quilt top rail 38. At this point, the fabric to be quilted/sewn 50 is held between the rails 38, 42, 46 of the quilting frame 26 as shown in FIG. 3.

The quilting frame 26 also includes two x axis (left/right) tracks 54. The x axis tracks 54 are mounted to the frame body 30 and are sufficiently strong to support the weight of the sewing machine 10. A sewing machine carriage 58 rests on top of the x axis tracks 54 and moves left and right along the x axis tracks 54. Typically, the x axis tracks 54 have a round or triangular cross-sectional shape for their upper surface. The bottom of the carriage 58 includes 4 rollers 62 at its four corners which roll on top of the tracks 54. Each roller may include two ball bearings mounted approximately 45 degrees left and right of vertical so that the edges of the two bearings engage the upper sides of the x axis tracks at an angle. The bearings roll across the tracks 54 and allow the sewing machine carriage 58 to roll freely across the tracks 54.

Two y axis (forwards/backwards) tracks 66 are mounted to the top of the sewing machine carriage 58. The sewing machine rests on top of the y axis tracks 66 and moves in the y axis along the y axis tracks 66. Typically, the y axis tracks 66 typically also have a round or triangular upper cross-sectional shape. Four rollers 70 are attached to the bottom of the sewing machine 10 (or a sewing machine base plate which supports the sewing machine) at its four corners. These rollers 70 roll on top of the y axis tracks 66. Each roller 70 may include two ball bearings mounted approximately 45 degrees left and right of vertical so that the edges of the two bearings engage the upper sides of the tracks at an angle. The bearings roll across the tracks 66 and allow the sewing machine 10 to roll freely across the tracks 66.

The x axis tracks 54 and y axis tracks 66 and corresponding rollers 62, 70 allow the sewing machine 10 to move left/right, forwards/backwards, and in coordinated motions relative to the quilting frame 26 and fabric 50 to sew any desired pattern into the quilt fabric 50. An operator will move the sewing machine 10 while sewing to stitch a desired pattern into the portion of the fabric 50 which is held between the take up rail 46 and the backing rail 42. When the person is done sewing in this area, the fabric 50 can be wound onto the take up rail 46 and simultaneously deployed from the backing rail 42 and quilt top rail 38 to position a new area of the fabric 50 for sewing. FIG. 3 illustrates a quilt 50 held by the quilting frame 26 and illustrates how an area of the quilt 50 is positioned to allow free hand sewing of the quilt.

Figure 4:
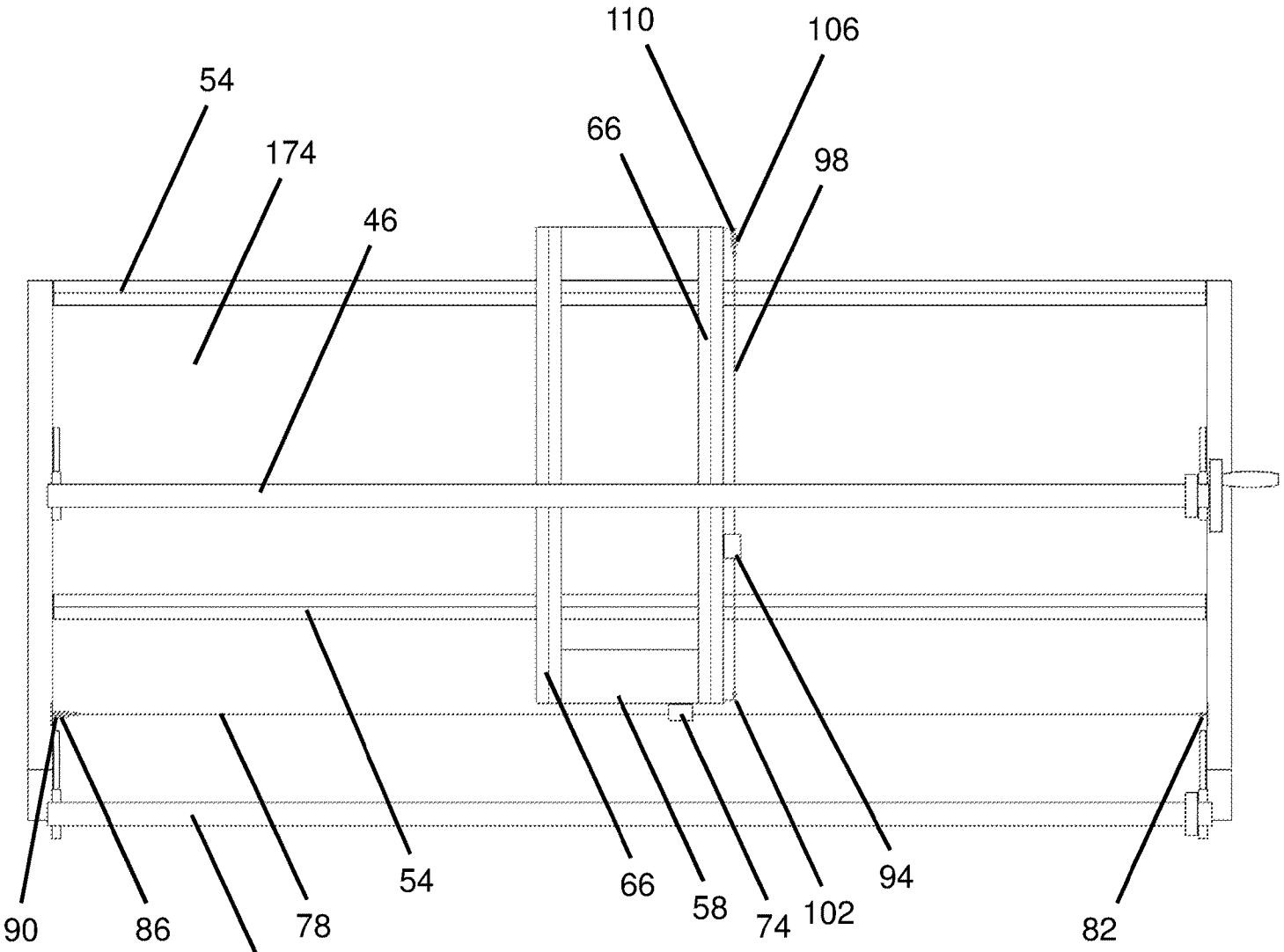
FIG. 4 is a top view drawing of the quilting frame.

FIG. 4 shows a top view of the quilting frame 26. The quilting system includes an x axis optical encoder 74 which is connected to the sewing machine carriage 58. The optical encoder 74 includes an optical sensor mounted within an enclosure and the electronics necessary to operate the optical sensor. An x axis flexible cord 78 is stretched across the quilting frame 26 between the left and right ends of the frame body 30. The cord 78 is provides a substrate for optical detection of movement by the optical sensor. The cord is typically a woven or braided textile cord and may be a round cord or more preferably a flat cord or a flat ribbon. A flexible ribbon 78 may be a ⅜ or ½ inch wide grosgrain textile ribbon or another similar textile ribbon. One end of the textile ribbon 78 is attached to the frame body 30 with a fastener 82 such as a screw eye 82. The other end of the textile ribbon 78 is attached to the other end of the frame body 30 with a spring 86 that connects the textile ribbon 78 to a fastener 90 such as a screw eye 90. The spring 86 is stretched somewhat when the textile ribbon 78 is installed and remains under tension to thereby apply tension to the textile ribbon 78 and hold the textile ribbon taught across the frame body 30. The textile ribbon 78 passes through a slot in the encoder enclosure and passes in front of the optical sensor. The x axis optical encoder 74 moves left and right with the sewing machine carriage 58 while the textile ribbon 78 remains stationary between the ends of the frame body 30. The textile ribbon is woven from individual fine threads or filaments and thus includes optical variation or texture along its length. Movement of the encoder 74 along the textile ribbon 78 allows the optical sensor within the encoder to detect movement of the sewing machine carriage 58 along the x axis of the quilting frame 26.

The quilting system also includes a y axis optical encoder 94 which is connected to the sewing machine 10. The optical encoder 94 includes an optical sensor mounted within an enclosure and the electronics necessary to operate the optical sensor. A y axis flexible cord 98 is stretched across the sewing machine carriage 58 between the front and back ends of the sewing machine carriage 58. The cord 98 is provides a substrate for optical detection of movement by the optical sensor. The cord is typically a woven or braided textile cord and may be a round cord or more preferably a flat cord or a flat ribbon. The flexible ribbon 98 may be a ⅜ or ½ inch wide grosgrain textile ribbon or another similar textile ribbon. One end of the textile ribbon 98 is attached to the sewing machine carriage 58 with a fastener 102 such as a screw eye 102. The other end of the textile ribbon 98 is attached to the other end of the sewing machine carriage 58 with a spring 106 that connects the textile ribbon 98 to a fastener 110 such as a screw eye 110. The spring 106 is stretched somewhat when the textile ribbon 98 is installed and remains under tension to thereby apply tension to the textile ribbon 98 and hold the textile ribbon taught across the sewing machine carriage 58. The textile ribbon 98 passes through a slot in the encoder enclosure and passes in front of the optical sensor. The y axis optical encoder 94 moves forwards and backwards with the sewing machine 10 while the textile ribbon 98 remains stationary (relative to the Y axis) between the ends of the sewing machine carriage 58. The textile ribbon is woven from individual fine threads or filaments and thus includes optical variation or texture along its length. Movement of the encoder 94 along the textile ribbon 98 allows the optical sensor within the encoder to detect movement of the sewing machine 10 relative to the sewing machine carriage 58 in the y axis direction and thus senses movement of the sewing machine 10 relative to the quilting frame 26.

Figure 5:
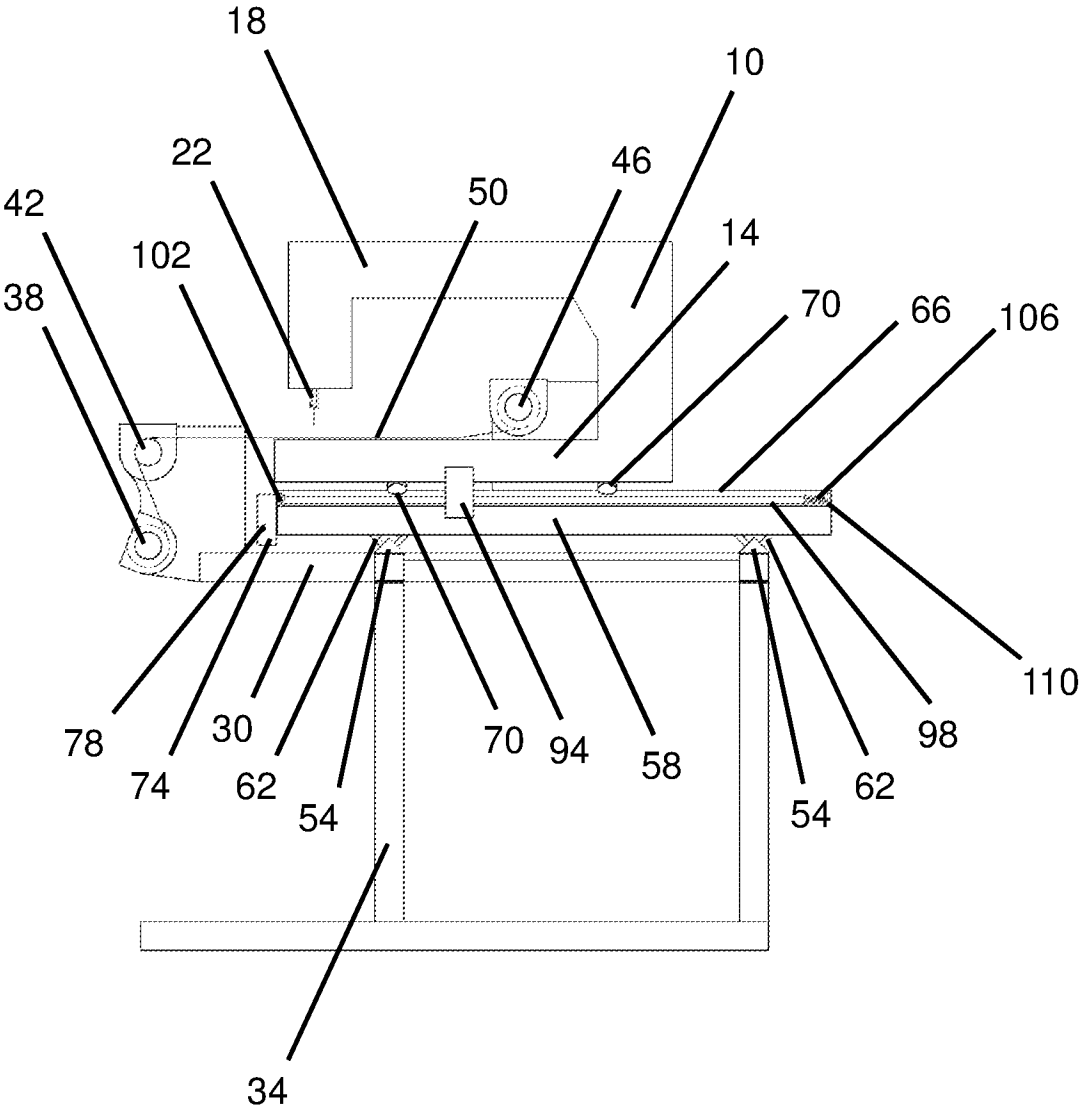
FIG. 5 is a side view drawing of the sewing machine and quilting frame.

FIG. 5 shows a partial side/end view of the quilting system. Various details of the system are better illustrated in this drawing. The drawing shows a cross-sectional view taken through the quilting frame 26 and does not show the end of the frame body 30 nearest the observer. The x axis tracks 54 and the y axis tracks 66 are shows as triangular tracks and the x axis rollers 62 and y axis rollers 70 each include 2 bearings mounted at angles so that the edges of the bearings contact the faces of the tracks. The x axis optical encoder 74 is mounted to the front of the sewing machine carriage 58. The y axis optical encoder 94 is mounted to the side of the sewing machine 10 or to a sewing machine base/carrier. It can be seen how the y axis ribbon 98 is mounted to the sewing machine carriage 58 and is held taught in a stationary position relative to the sewing machine carriage 58. As the sewing machine 10 moves forwards and backwards on the y axis tracks 66, the optical encoder moves with the sewing machine 10 and detects movement relative to the ribbon 98.

Figure 6:
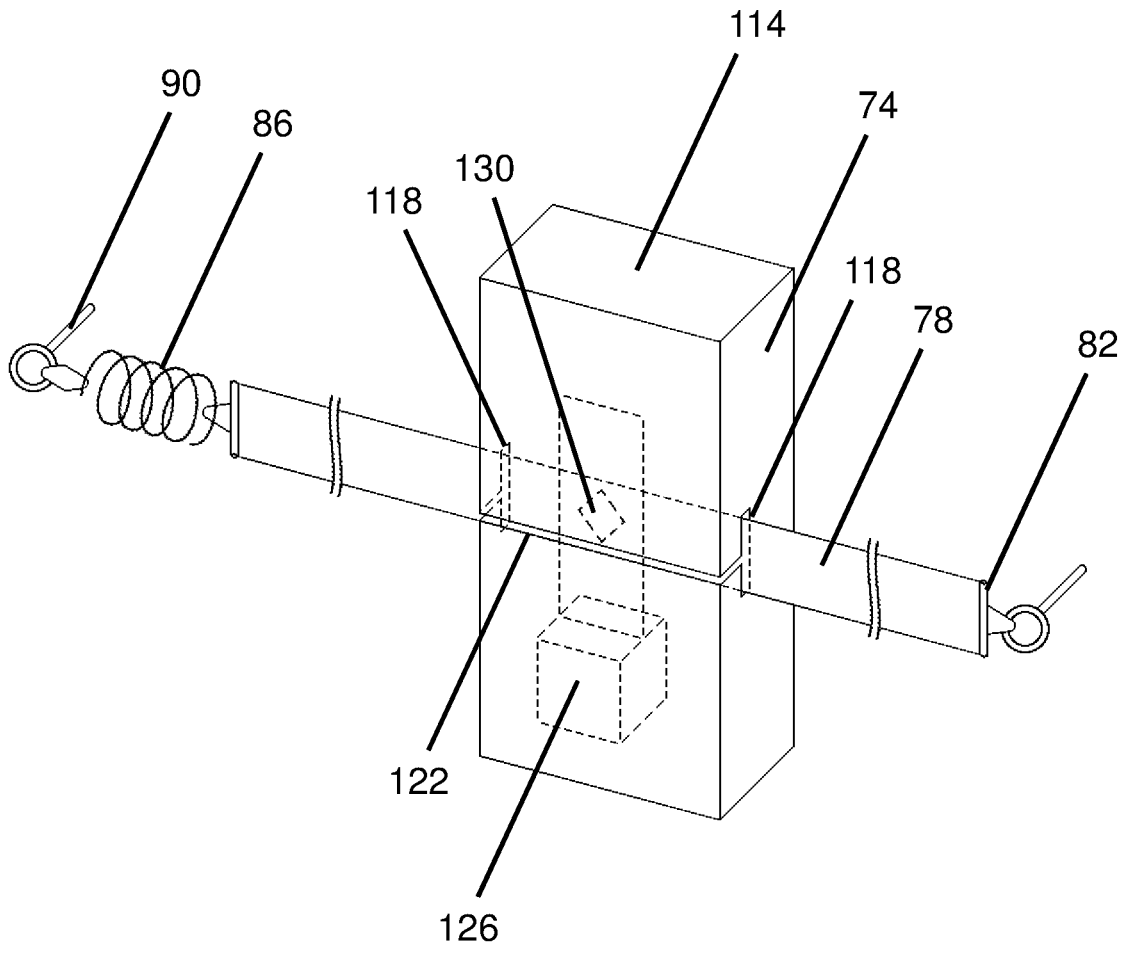
FIG. 6 is a perspective view drawing of the optical encoder and ribbon.

FIG. 6 shows a perspective view of an optical encoder 74 and the corresponding ribbon 78. The optical encoder 94 and ribbon 98 have the same structures and function in the same manner. The encoder 74 includes a housing 114. The encoder housing 114 houses the optical emitter and detector (optical sensor) and the electronic components used to operate the sensor. A ribbon slot 118 is formed in two opposite sides of the encoder housing 114. An insertion slot 122 is formed through an adjacent face of the encoder housing 114 such as the front face of the encoder housing 114. The insertion slot 122 intersects the encoder housing generally perpendicular to the ribbon slots 118 and connects to the ribbon slots 118; connecting the ribbon slots 118 to each other. In use, a ribbon 78 need not be threaded through the ribbon slots 118. Instead, a long edge of the ribbon 78 may be inserted into the insertion slot and the flexible ribbon can be moved transversely through the insertion slot 122 and placed into the ribbon slots 118. The ribbon slots 118 position the ribbon 78 in front of the optical sensor 130 in a desired position for use.

While a textile ribbon is particularly described, other flexible materials may be used with the optical encoder 74, 94 as the optical encoder is able to sense movement of a relatively small item. For example, a ribbon or flexible strap or webbing, or a length of braided or woven cord or thread could be used. If a narrower width of ribbon 78 is used with the optical encoder 74, 94, the ribbon slot 118 would typically be shorter to position the ribbon over the optical sensor 130. If a round cord or thread is used with the optical encoder 74, 94, the ribbon slot 118 would typically be a round hole, narrower slot, or a V shaped slot which positions the cord in front of the optical sensor. Such a ribbon slot 118 would typically be used with an insertion slot 122.

One end of the ribbon 78 is secured to the quilting frame 26 with a fastener 82 such as a screw eye or bolt. The other end of the ribbon is secured to a spring 86 which is in turn secured to the quilting frame 26 with a fastener 90 such as a screw eye or bolt. The spring 86 holds the ribbon in tension in the desired position on the quilting frame 26.

The ribbon is typically mounted in the orientation shown. The length of the ribbon 78 extends horizontally along the quilting frame 26. The ribbon 78 is held with its width oriented vertically. In this position, a single narrow edge of the ribbon 78 faces upwardly and the ribbon 78 collects very little dust. The encoder housing 114 protects the optical sensor and keeps dust from accumulating on the optical sensor. The ribbon slot 118 provides a small amount of space around the ribbon 78 and prevents foreign objects from entering the encoder housing 114. If some dust accumulates in the encoder housing, compressed air can be used to blow the dust out of the housing 114. A data connection port 126, such as an RJ45 port, is located at the bottom of the encoder housing 114 and is electrically connected to the optical sensor 130. The data connection port is used to connect the optical encoder 74 to the sewing machine motor speed controller.

Figure 7:
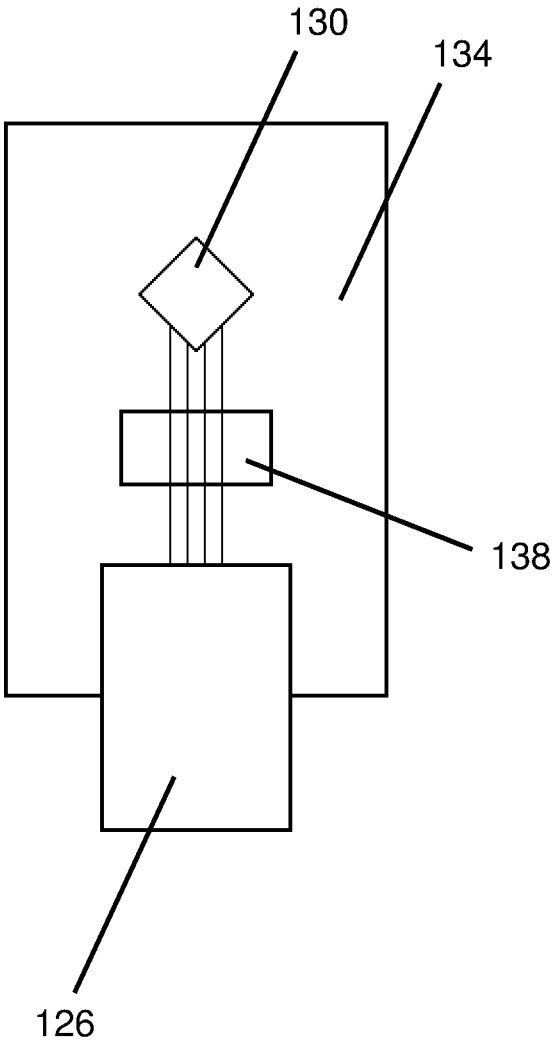
FIG. 7 is a schematic drawing of the optical encoder.

FIG. 7 shows a schematic diagram of the encoder circuit board and electronic hardware. The encoder electronics typically include a circuit board 134 which carries the electronic components. The data connection port 126 connects the encoder 74 to the sewing machine motor controller, provides electrical power to the optical sensor 130, and transmits data from the optical sensor 130 to the sewing machine motor controller. The data connection port 126 is electrically connected to the optical sensor 130. The optical sensor 130 may be a discrete component or may be part of a more complete integrated circuit. The optical sensor includes an optical emitter such as a low power LED, optics such as a lens or waveguide, and an optical detector such as a CMOS sensor chip. The optical detector receives light which is reflected off of the ribbon 78 and detects relative movement of the ribbon 78 and the optical encoder 74 based on movement between images captured by the optical detector. The optical encoder 74 may include an additional integrated circuit 138 which may be a processing chip used to convert the output of the optical sensor 130 to the type of signal received by the sewing machine motor controller.

Figure 8:
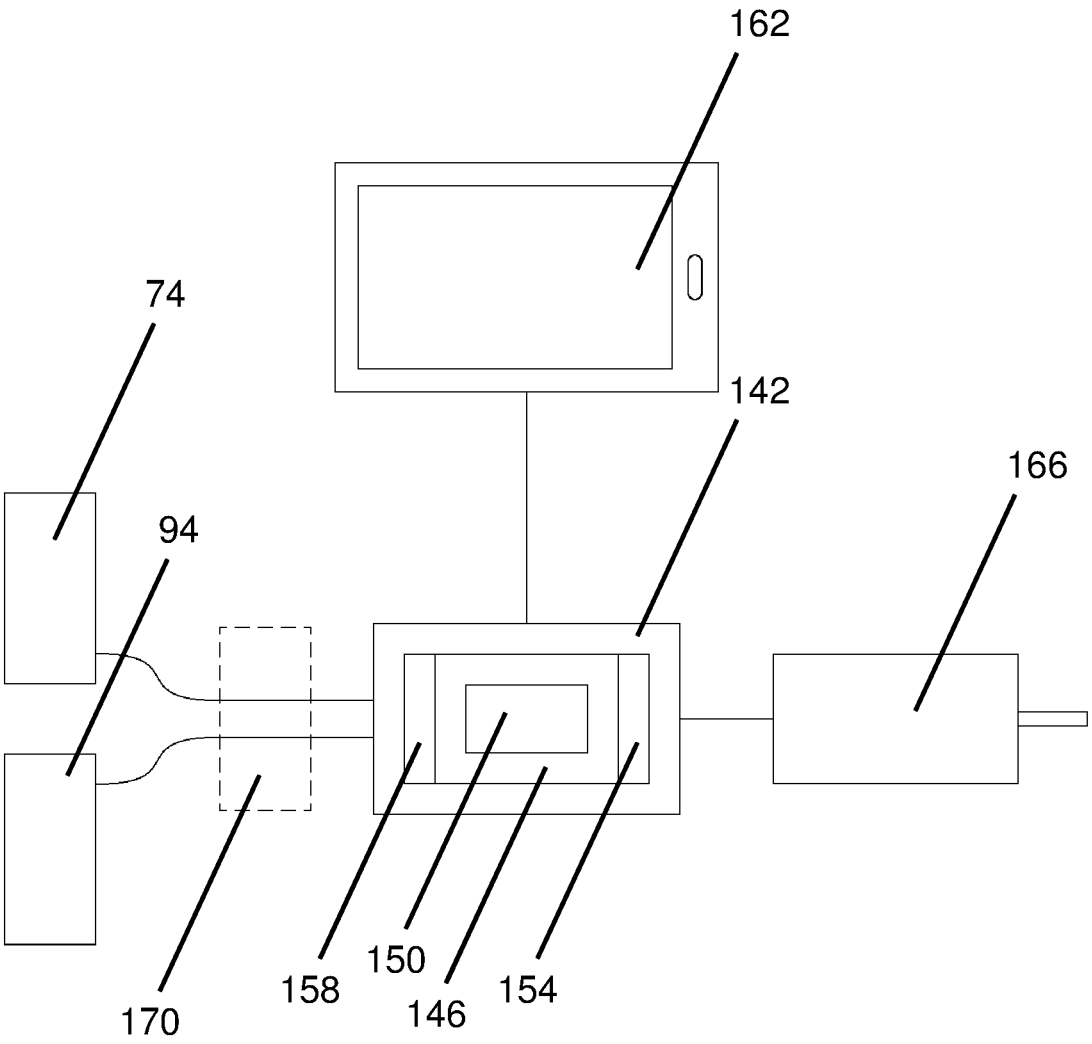
FIG. 8 is a schematic drawing of the stitch regulation system.

FIG. 8 shows a schematic diagram of the electronic components used in the quilting system. The optical encoders 74, 94 are connected to a stitch regulation motor controller 142. The motor controller 142 typically includes a processing device 146 which can include memory, e.g., read only memory (ROM) and random access memory (RAM), storing processor-executable instructions and one or more processors that execute the processor-executable instructions. The processing device 142 can execute the software/firmware used to receive data and operate the sewing machine motor. In one example, the processing device 142 executes a stitch regulation module 150. The motor controller 142 may also include memory 154 such as a hard disk drive or solid state memory. The memory 154 may store the stitch regulation software used to execute the stitch regulation module and operate the sewing machine motor. The motor controller may also include an interface device 158 which performs communications and data interface functions. The interface device 158 may send and receive data from the motor controller. The interface device 158 may include a data interface which receives data from the optical encoders 74, 94. The interface device 158 may include a data interface which sends and receives data to/from a user interface 162. The interface device 158 may also include a motor input/output which sends electricity to the sewing machine motor 166 to operate the sewing machine motor. The motor input/output may also sense the operational speed or state of the sewing machine motor 166.

The user interface 162 is a device that allows a user to interact with the stitch regulation motor controller 142 and sewing machine 10. While one user interface 162 is shown, the term "user interface" can include, but is not limited to, a touch screen, a physical keyboard, a mouse, etc. The example user interface shown is a small tablet computer or cell phone. The user interface may receive data from the sewing machine motor controller and display operational parameters to the user. The user interface may allow the user to select operational parameters for the operation of the sewing machine 10. In particular, the user interface may allow the user to select a target stitch length for the sewing machine 10. Where little other input/output is required, the user interface may be a potentiometer or other simple device which allows for user input to select a stitch length by varying an electrical parameter.

The sewing machine motor 166 is connected to the sewing head 22 via a drivetrain and operates the sewing machine to make stitches. Sewing machine stitch frequency is proportional to sewing machine motor revolutions per minute (RPM). Accordingly, the sewing machine stitch speed can be varied by varying the motor RPM.

In some situations, a secondary processor 170 may be used as an interface between the optical encoders 74, 94 and the stitch regulation motor controller 142. The secondary processor 170 may be used in retrofit situations where stitch regulation is being added to a sewing machine. A secondary processor 170 may be used where the motor controller 142 is not configured to perform stitch regulation functions and the secondary processor may perform the stitch regulation functions as discussed herein. Alternatively, a secondary processor 170 may be used to change the output pulse frequency/signal of the optical encoders 74, 94, etc. to interface with an existing stitch regulation processor. A secondary processor 170 may include a processing device, memory, and a data/communications interface as discussed above. The various computational steps and processes discussed herein may be distributed between a stitch regulation motor controller 142 and a secondary processor 170 as may be advantageous for a particular installation.

The sewing machine motor controller is used to regulate the length of stitches formed in the fabric 50 by varying the speed of the sewing machine motor 166 according to relative speed between the sewing machine and the fabric 50. The user speed in sewing along a pattern may vary and the stitch regulation motor controller 142 varies the speed of the sewing machine motor 166 accordingly to create a desired stitch length. The stitch regulation motor controller 142 receives a stitch length setting from the user such as by the user moving a potentiometer or other input device or by entering a desired stitch length into a user interface such as a tablet computer. The stitch regulation motor controller 142 receives movement data from the x axis encoder 74 and from the y axis encoder 94. The movement data from the optical encoders 74, 94 is typically a series of pulses which represent a direction of movement and distance of movement sensed by the optical sensor. In one example, the optical encoders may output a quadrature signal which provides distance and direction movement data. The optical encoder output is typically characterized in terms of output pulses per distance of movement; such as 100 or 400 pulses per inch of movement. If the optical encoder output is 100 pulses per inch of movement and the sewing machine motor controller receives 10 pulses from the x axis encoder, it determines that the needle has moved 0.1 inches along the x axis.

The stitch regulation motor controller 142 operates the sewing machine motor 166 at a desired speed to create stitches. In one example, the sewing machine motor controller may operate the sewing machine motor based on an observed speed of the needle relative to the cloth. The stitch regulation motor controller 142 may calculate x and y axis movement speeds from the number of pulses reported by the x and y axis encoders in a period of time. The stitch regulation motor controller 142 may sum the x axis movement speed and the y axis movement speed to create a total movement speed of the needle relative to the cloth and operate the sewing machine motor 166 to create stitches at the desired rate/length. This calculation will create slightly smaller stitches when the need is moving in a direction with both x and y axis components. Alternatively, the stitch regulation motor controller 142 may square the x axis movement speed, square the y axis movement speed, and add the squares of the x and y axis movement speeds together to create a squared movement speed. The stitch regulation motor controller 142 may then take the square root of the squared movement speed and operate the sewing machine motor 166 at the desired speed to create stitches. Alternatively, the stitch regulation motor controller 142 may compare the squared movement speed against a non-linear curve or lookup table relating the squared speed to motor speed and operate the sewing machine motor 166 to create stitches at a desired length.

In another example, the sewing machine motor controller may operate the sewing machine motor 166 according to an observed distance traveled by the needle relative to the cloth. The sewing machine motor controller may sum the distance reported by the x axis encoder and the y axis encoder and identify stitch events based on the distance traveled following the previous stitch event. The stitch regulation motor controller 142 may determine a sewing machine motor operating speed from the calculated frequency of stitch events. The stitch regulation motor controller 142 may square the sum of the x axis encoder pulse distance since the last stitch event, square the sum of the y axis encoder distance since the last stitch event, and sum the squares of the x and y axis distance since the last stitch event. This calculates for movement of the needle relative to the cloth with both x and y movement components. The stitch regulation motor controller 142 may operate the sewing machine motor 166 according to an averaged frequency of calculated stitch events.

The sewing machine 10 may have an onboard motor driver which operates the sewing machine motor 166 at a user selected RPM according to a foot pedal position or a slider or dial position. The motor driver may receive an input signal such as a voltage or resistance value from the foot pedal, slider, or dial and may operate the sewing machine motor 166 at a speed corresponding to the input signal. The sewing machine 10 may be characterized as creating a certain number of stitches for a certain number of revolutions of the sewing machine motor 166, or a certain stitch speed for a given motor speed. The stitch regulation motor controller 142 may provide a signal to the sewing machine motor driver to operate the sewing machine motor 166 at a desired speed and thereby create stitches at a desired rate. Accordingly, the stitch regulation motor controller 142 may:

Receive a stitch length setting from a user

Receive movement data from optical encoders

Calculate cloth movement information from encoder data
Calculate stitch events from encoder movement data
Calculate stitch frequency from encoder movement data
Output a signal to a sewing machine motor driver according to a desired stitch frequency
Cause operation of the sewing machine motor at a desired speed to create stitches at a desired frequency
Continue to receive movement data from optical encoders
Calculate current cloth movement information from encoder data
Calculate current stitch frequency from movement information
Operate sewing motor at speed corresponding to current stitch frequency
Continue operating sewing machine motor according to current cloth movement information and resulting stitch frequency The optical encoders 74, 94 are advantageous as they are very accurate and also very resistant errors due to dust and debris. The narrow ribbon 78, 98, particularly when used with the width of the ribbon in a vertical orientation, is resistant to collecting dust and debris. Dust on the face of the ribbon 78, 98 does not alter the encoder readout as the optical sensor 130 can sense the movement of the ribbon 78, 98 with any stains or debris carried by the ribbon. The encoder 74, 94 and ribbon 78, 98 are easily cleaned and serviced if needed.

Figure 9:
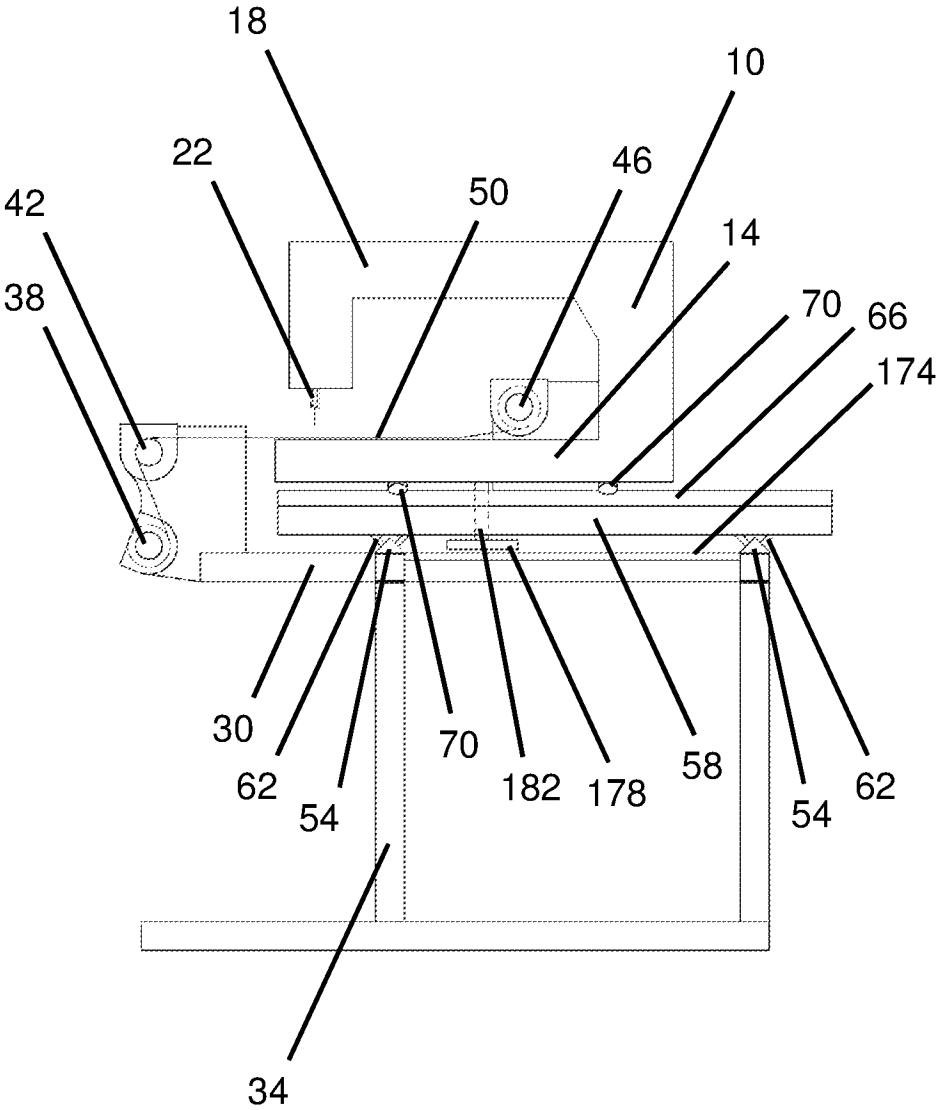
FIG. 9 is a side view drawing of a sewing machine and quilting frame.

FIG. 9 shows another optical encoder configuration for a sewing machine 10 and quilting frame 26. The sewing machine 10 and quilting frame 26 are as described above except as otherwise noted. For brevity, some structures are not described in detail in relationship to FIG. 9 but are understood to be present and to function as described above. The quilting frame 26 may include a horizontal panel 174 which is attached to the frame body 30. In the example quilting frame 26, the horizontal panel 174 extends side to side between the ends of the frame body 30 and front to back between the x axis tracks 54. The horizontal panel 174 is continuous in this region. An optical movement encoder 178 is attached to the bottom of the sewing machine 10 or to a base which carries the sewing machine 10. The optical encoder 178 may be attached to the base or bottom of the sewing machine 10 via a vertical standoff 182 or another mount 182 which positions the optical encoder 178 above the horizontal panel 174 and adjacent to the optical panel 174.

The horizontal panel 174 may include a finely textured surface texture or finish which promotes recognition of movement by the optical sensor. The optical sensor typically includes an LED optical emitter which emits light onto the horizontal surface 174 and an optical imaging sensor which detects reflected light from the horizontal surface 174 and detects movement of the optical sensor relative to the horizontal surface 174 via movement of a detected image in the optical detector.

The optical movement encoder 178 includes components as discussed in FIG. 7 and with respect to the optical encoders 74, 94 above except as otherwise noted. The sensor electronics typically include a circuit board 134 which carries the electronic components. The data connection port 126 connects the movement encoder 178 to the sewing machine motor controller, provides electrical power to the optical sensor 130, and transmits data from the optical sensor 130 to the sewing machine motor controller. The data connection port 126 is electrically connected to the optical sensor 130. The optical sensor 130 may be a discrete component or may be part of a more complete integrated circuit. The optical sensor includes an optical emitter such as a lower power LED and an optical detector such as a CMOS sensor chip. The optical detector receives light which is reflected off of the horizontal surface 174 and detects relative movement of the optical movement encoder 178 and the horizontal surface 174 based on movement of light patterns across the optical detector. The optical movement encoder 178 may include an additional integrated circuit 138 which may be a processing chip used to convert the output of the optical sensor 130 to the type of signal received by the sewing machine motor controller. The optical sensor 130 used in the optical movement encoder 178 detects movement in both the x and y axis directions and the optical movement encoder 178 outputs both x axis movement data and y axis movement data to the dewing machine motor controller 142. Otherwise, the processing of movement data is handled as discussed above. The optical movement detector 178 allows the stitch regulation motor controller 142 to detect the movement of the sewing machine 10 relative to cloth mounted in the quilting frame 26 and thereby vary the speed of the sewing machine motor to regulate the length of stitches made by the sewing machine as a user sews with the sewing machine 10.

Figure 10:
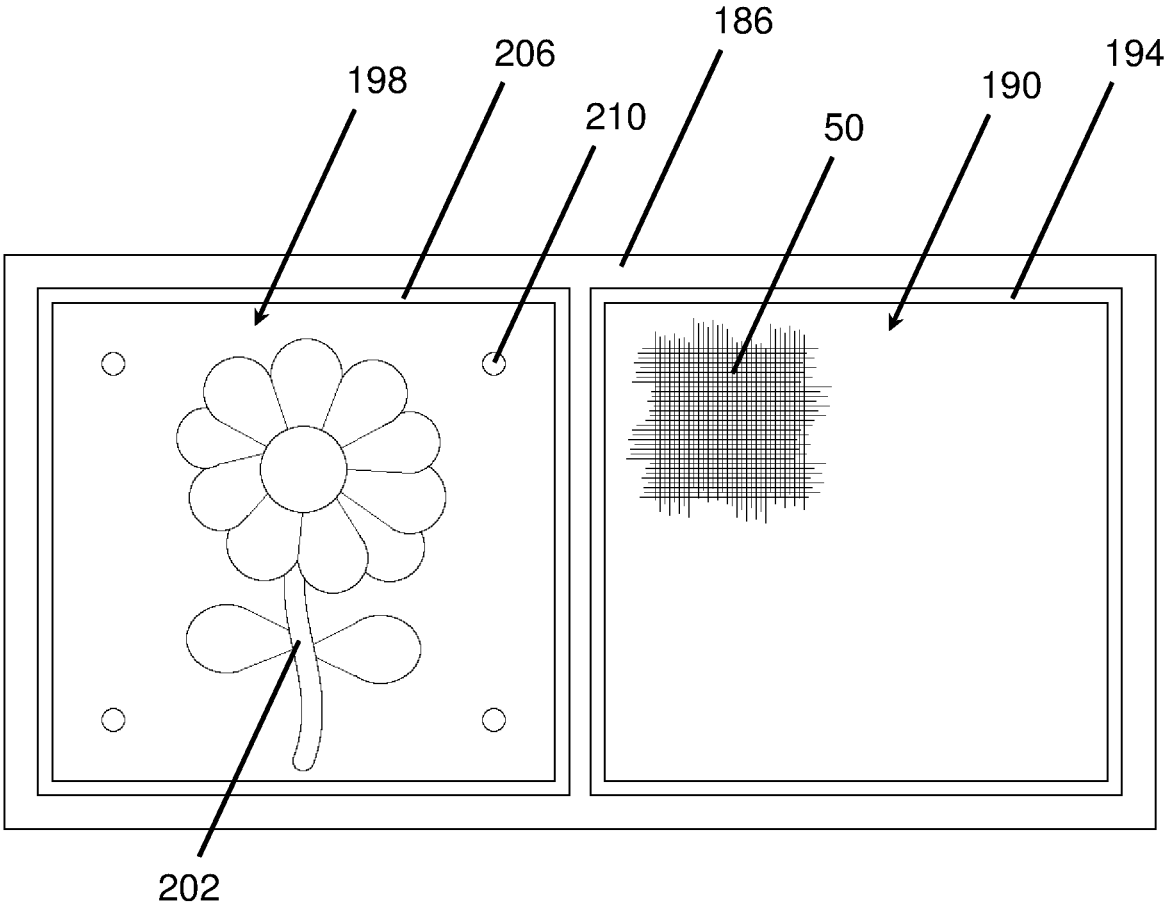
FIG. 10 is a top view drawing of a sewing frame.
Figure 11:
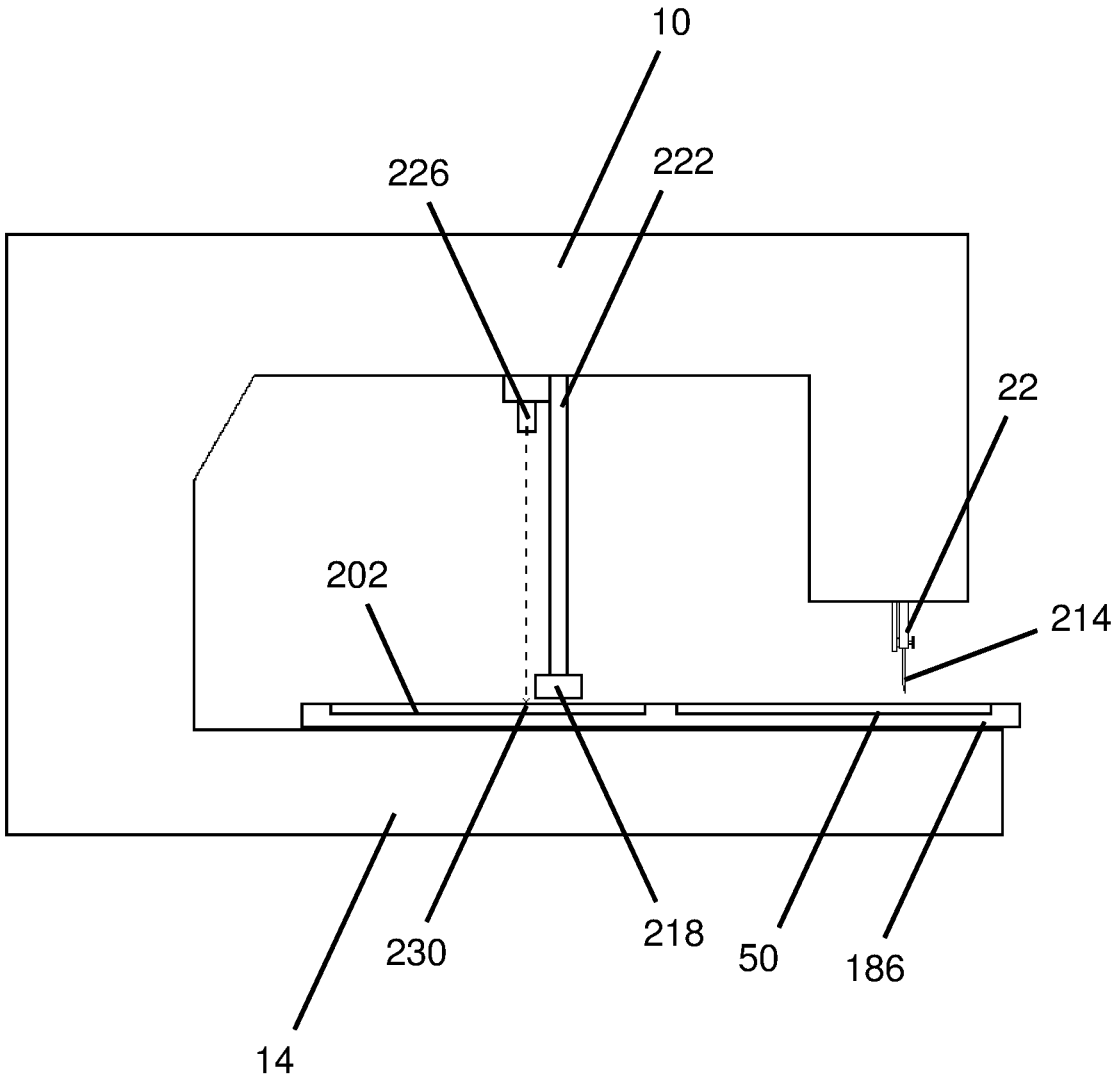
FIG. 11 is a side view drawing of the sewing frame and a sewing machine.

FIGS. 10 and 11 show another optical encoder configuration for a sewing machine 10. A sewing frame 186 is shown in FIG. 10. The sewing frame 186 includes a first section 190 which holds a section of fabric 50 for sewing. The first section 190 is open and allows fabric 50 to span across the first section 190 adjacent the bottom of the frame 186 where it can be sewed by the sewing machine 10. The first section 190 typically occupies approximately the right half of the sewing frame 186. An edge clamp 194 or clips hold a section of fabric 50 stretched across the first section 190 for sewing. The sewing frame 186 includes a second section 198 which holds a drawing or pattern 202 for sewing. The second section 198 is a similar size and shape as the first section 190. The drawing or pattern 202 could be a photograph, paper drawing, etc. The sewing pattern 202 can be held into the second section 198 by an edge clamp or edge clips 206 or magnets 210.

FIG. 11 shows the sewing frame 186 in use with a sewing machine 10. The sewing frame 186 is placed in the sewing machine 10 so that the needle 214 is positioned over the cloth 50 in the first section 190 of the sewing frame 186 and so that the second section 198 is positioned in the throat of the sewing machine 10. An optical encoder 218 is attached to the sewing machine 10 with a mount 222 which positions the optical encoder 218 above the sewing pattern 202. In this position, an optical sensor 130 in the optical encoder 218 can sense movement of the sewing pattern 202 relative to the optical encoder 218. An alignment marker 226, such as laser 226, indicates a tracing position 230 on the sewing pattern. The optical encoder 218 senses both x axis movement and y axis movement of the sewing pattern 202 and outputs x axis movement data and y axis movement data to the stitch regulation motor controller 142 as a user moves the sewing frame 186 to sew into the cloth 50.

In use, a user moves the sewing frame 186 to trace the sewing pattern 202 with the tracing indicator 230. This movement of the sewing frame causes corresponding movement of the cloth 50 beneath the sewing needle 214. The optical encoder 218 senses the movement of the sewing pattern 202 and operates the sewing machine motor 166 to cause the sewing machine 10 to form stitches in the cloth 50. The stitch regulation motor controller 142 uses the movement data from the optical encoder 218 to vary the speed of the sewing machine motor 166 to create stitches of a user selected length as discussed above.

The configuration of the sewing frame 186 allows a section of cloth 50 with a width which is approximately one half of the sewing machine throat depth to be sewn. The cloth 50 may have a longer length, as there is little restriction on the front to back clearance of an article being sewing in the sewing machine 10. If desired, the optical encoder 218, mount 222, alignment laser 226, and tracing position indicator 230 could be moved to a position outboard of the sewing head 22 such as with a mount 222 that includes an arm which extends outwardly (to the right as drawn) to position the optical encoder 218 and tracing position indicator 230 to the right of the sewing head 222 and needle 214. This would create a larger overall system, but would allow for a larger sewing frame 186 in the left to right dimension and a correspondingly larger left to right sewing area 190. In this configuration, the sewing frame 186 would be used with the first, sewing section/area 190 on the left side and the second, pattern section/area 198 on the right side underneath the encoder 218 and the tracing position indicator 230. This sewing system is advantageous in allowing quilting projects to be sewn on a sewing machine with better regulation of stitch length as user sewing speed varies. The system is also useful in allowing for stitch regulation with freehand and traced sewing and embroidery work.

Figure 12:
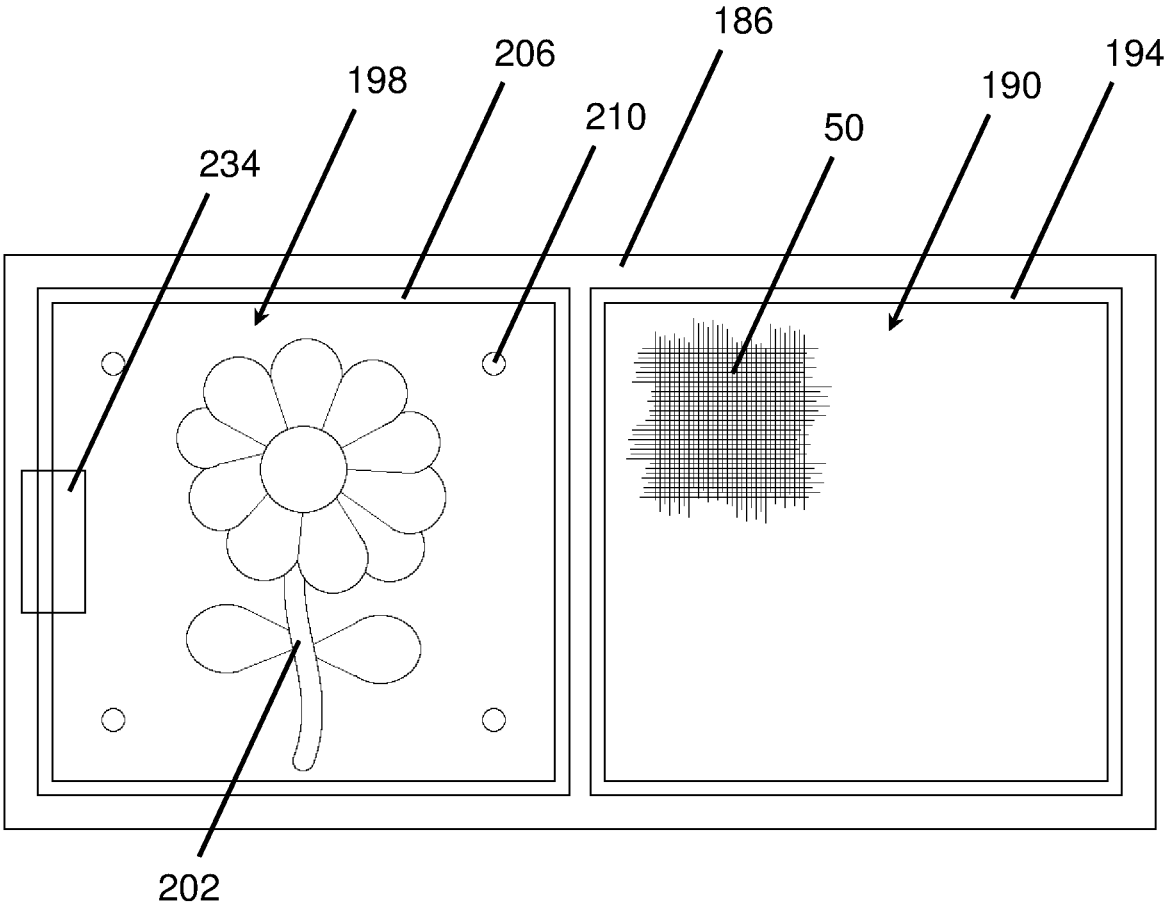
FIG. 12 is a top view drawing of a sewing frame.
Figure 13:
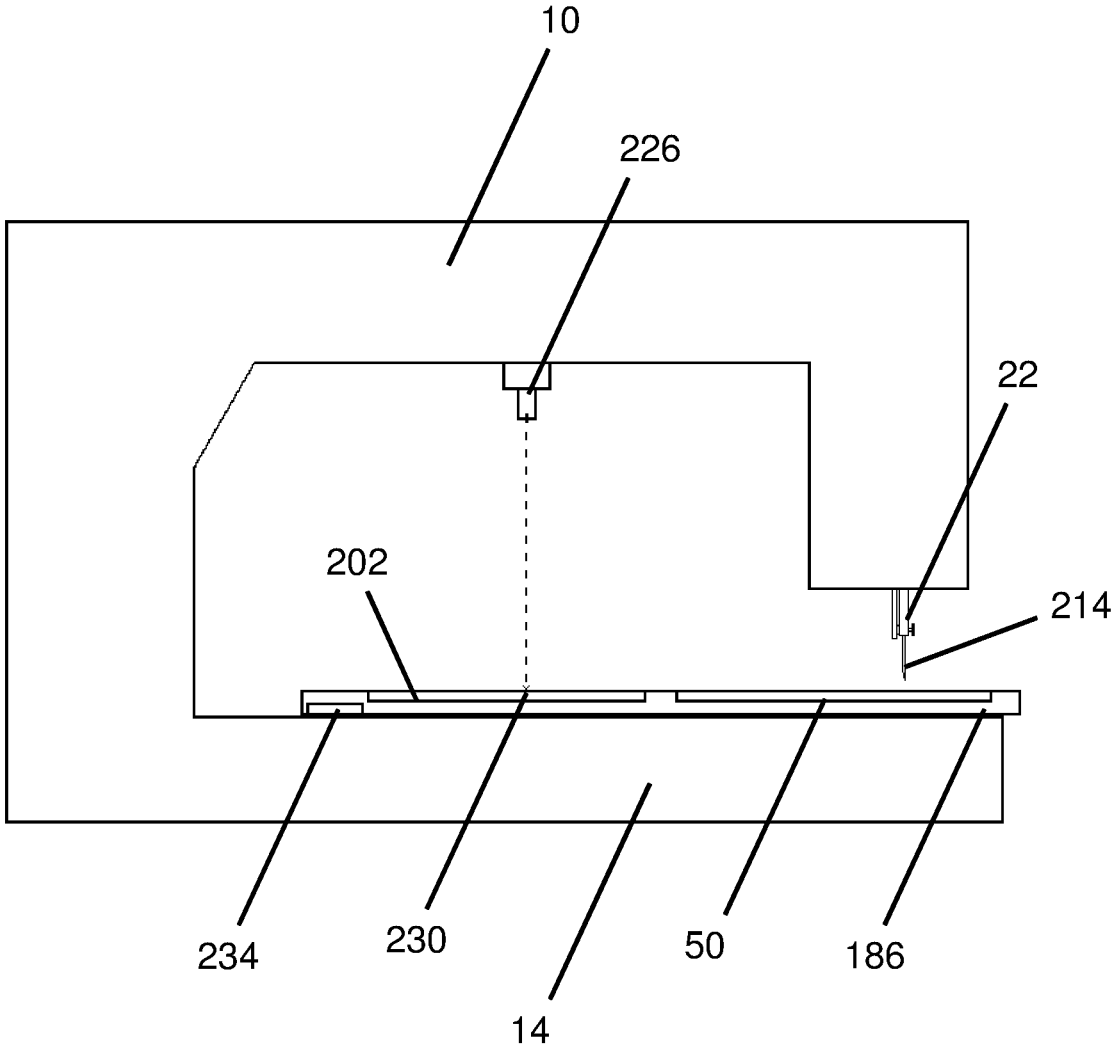
FIG. 13 is a side view drawing of the sewing frame and a sewing machine.

FIGS. 12 and 13 show another optical encoder configuration for a sewing machine 10. A sewing frame 186 is shown in FIG. 12. The sewing frame 186 includes a first section 190 which holds a section of fabric 50 for sewing. The first section 190 is open and allows fabric 50 to span across the first section 190 adjacent the bottom of the frame 186 where it can be sewed by the sewing machine 10. The first section 190 typically occupies approximately the right half of the sewing frame 186. An edge clamp 194 or clips hold a section of fabric 50 stretched across the first section 190 for sewing. The sewing frame 186 includes a second section 198 which holds a drawing or pattern 202 for sewing. The second section 198 is a similar size and shape as the first section 190. The drawing or pattern 202 could be a photograph, paper drawing, etc. The sewing pattern 202 can be held into the second section 198 by an edge clamp or edge clips 206 or magnets 210.

An optical encoder 234 is attached to the sewing frame 186. The optical encoder 234 is positioned adjacent the bottom of the sewing frame 186. In this position, an optical sensor 130 in the optical encoder 218 can sense movement of the optical encoder 234 relative to the sewing machine bed 14. The optical encoder 234 senses both x axis movement and y axis movement of the sewing frame 186 and outputs x axis movement data and y axis movement data to the stitch regulation motor controller 142 as a user moves the sewing frame 186 to sew into the cloth 50.

FIG. 13 shows the sewing frame 186 in use with a sewing machine 10. The sewing frame 186 is placed in the sewing machine 10 so that the sewing machine needle 214 is positioned over the cloth 50 in the first section 190 of the sewing frame 186 and so that the second section 198 is positioned in the throat of the sewing machine 10. An alignment marker 226, such as laser 226, indicates a tracing position 230 on the sewing pattern. A user may trace the sewing pattern 202 under the alignment marker tracing position 230 causing corresponding movement of the cloth under the sewing machine needle 214. The optical encoder 234 senses both x axis movement and y axis movement of the sewing frame 186 relative to the sewing machine bed 14 and outputs x axis movement data and y axis movement data to the stitch regulation motor controller 142 as a user moves the sewing frame 186 to sew into the cloth 50.

In use, a user moves the sewing frame 186 to trace along the sewing pattern 202 with the tracing indicator 230. The movement of the sewing frame 186 causes corresponding movement of the cloth 50 beneath the sewing needle 214. The optical encoder 234 senses the movement of the sewing frame 186 relative to the sewing machine bed 14 and the motor controller 142 operates the sewing machine motor 166 to cause the sewing machine 10 to form stitches in the cloth 50. The stitch regulation motor controller 142 uses the movement data from the optical encoder 234 to vary the speed of the sewing machine motor 166 to create stitches of a user selected length as discussed above.

Figure 14:
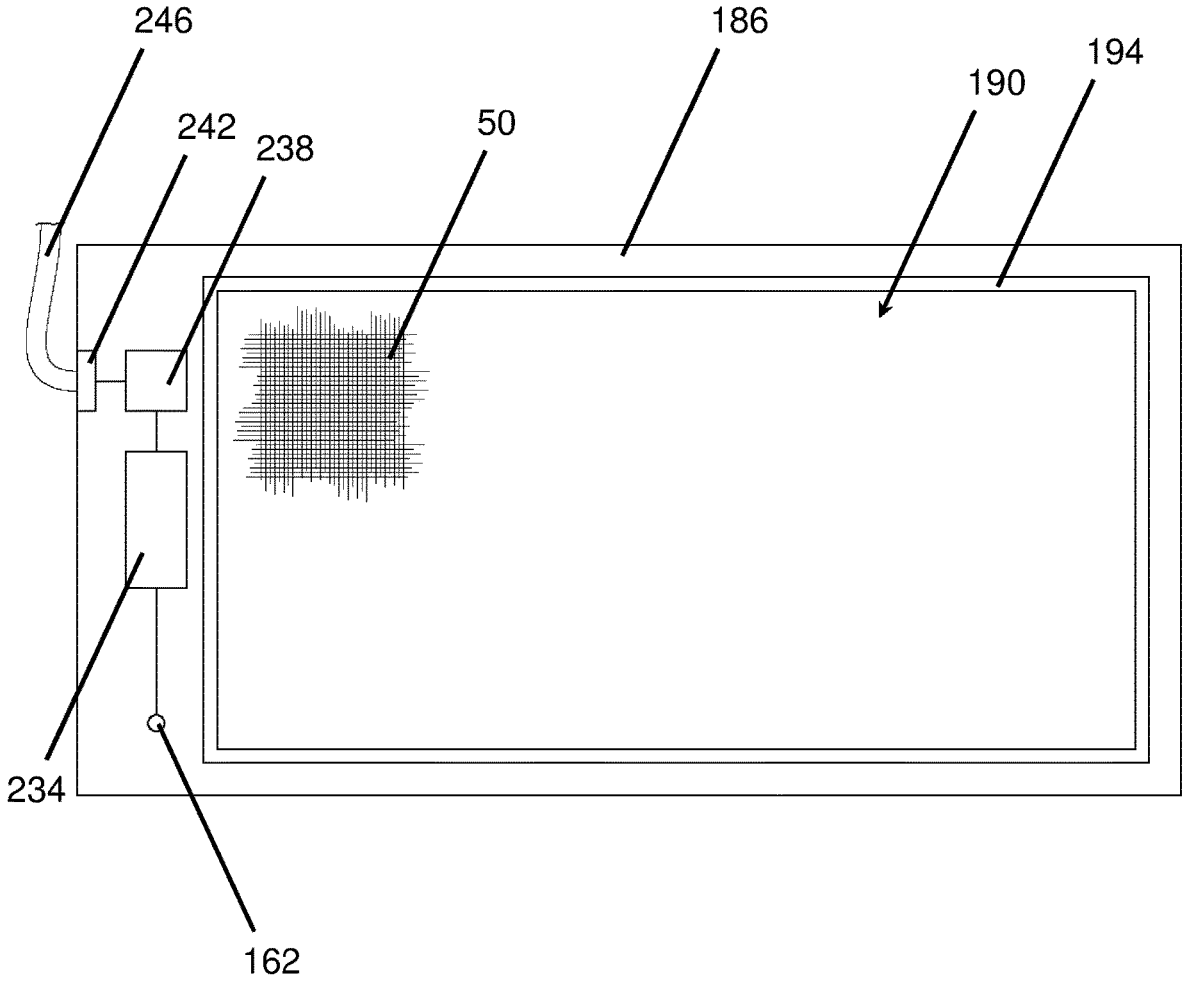
FIG. 14 is a top view drawing of a sewing frame.
Figure 15:
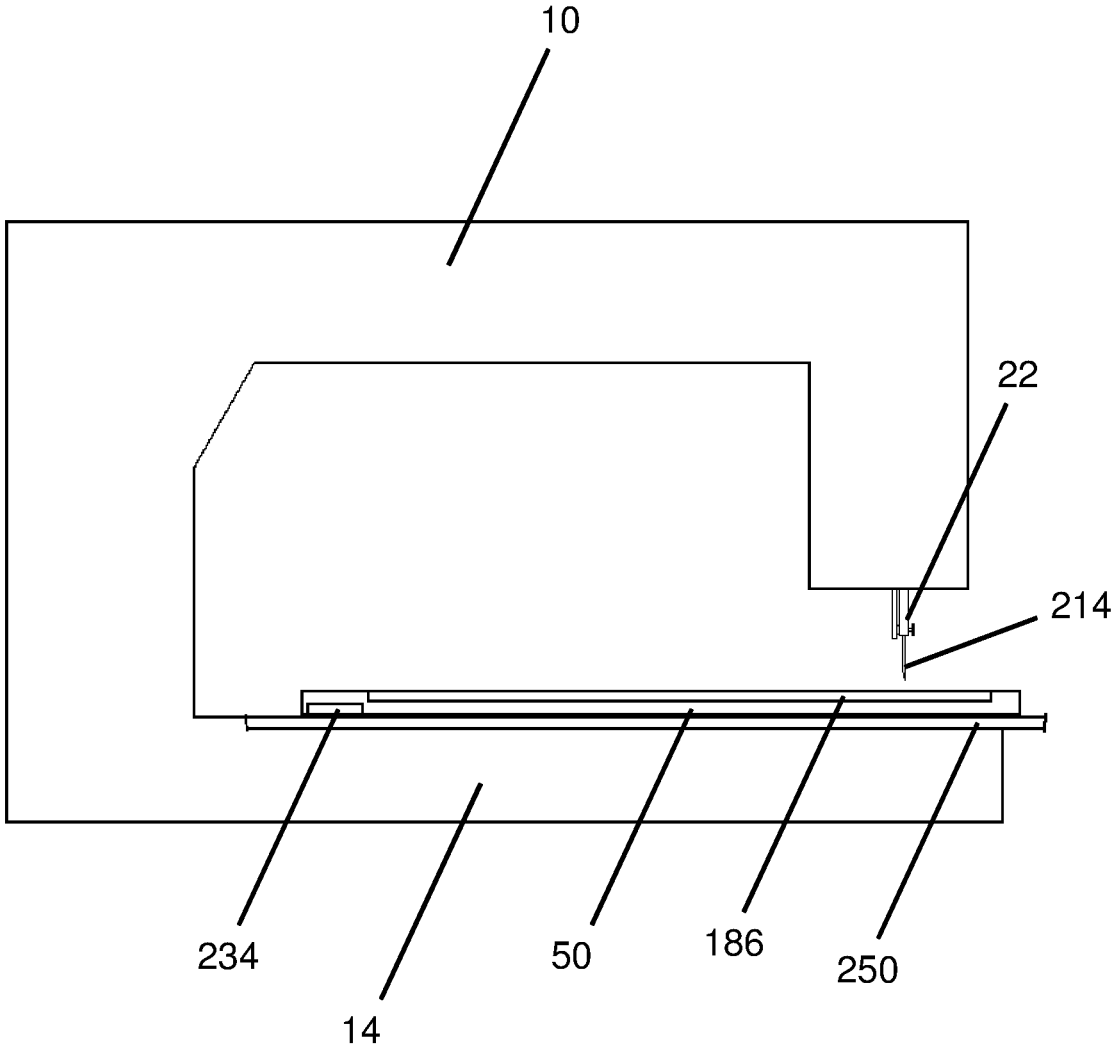
FIG. 15 is a side view drawing of the sewing frame and a sewing machine.

FIGS. 14 and 15 show another optical encoder configuration for a sewing machine 10. A sewing frame 186 is shown in FIG. 14. The sewing frame 186 includes a first section 190 which holds a section of fabric 50 for sewing. The first section 190 is open and allows fabric 50 to span across the first section 190 adjacent the bottom of the frame 186 where it can be sewed by the sewing machine 10. The first section 190 typically occupies a majority of the size of the sewing frame 186. An edge clamp 194 or clips hold a section of fabric 50 stretched across the first section 190 for sewing.

An optical encoder 234 is attached to the sewing frame 186. The optical encoder 234 is positioned adjacent the bottom of the sewing frame 186 with an optical sensor 130 which senses movement of objects beneath the sewing frame 186. In this position, an optical sensor 130 in the optical encoder 218 can sense movement of the optical encoder 234 relative to the sewing machine bed 14 or relative to a table or support surrounding the sewing machine bed 14. The optical encoder 234 senses both x axis movement and y axis movement of the sewing frame 186 relative to the sewing machine bed 14 and outputs x axis movement data and y axis movement data to the stitch regulation motor controller 142 as a user moves the sewing frame 186 to sew into the cloth 50.

The sewing frame 186 may also include additional electronic components which are part of the system to control the speed of the sewing machine motor 166 and regulate the length of stitches. For example, the sewing frame 186 may include a computer processor 238. The computer processor 238 may be a motor controller 142 and perform the functions of the motor controller 142 described above. The processor 238 may also be a secondary processor which may perform functions such as processor 170 described above. The sewing frame 186 may include a user interface 162 which allows a user to select a desired stitch length or adjust the length of stitches created by the sewing machine 10. The sewing frame 186 may also include a connection port 242 which allows a cable 246 to be connected to the sewing frame 186 and to a sewing machine 10 and thereby connect the sewing frame 186 to a sewing machine 10.

FIG. 15 shows the sewing frame 186 in use with a sewing machine 10. The sewing frame 186 is placed in the throat of the sewing machine 10 so that the sewing machine needle 214 is positioned over the cloth 50 in the first section 190 of the sewing frame 186. A table or support surface 250 may be attached to the sewing machine 10 so that the support surface 250 is approximately level with the sewing machine bed 14. Such a support surface increases the area of the sewing machine bed 14 and also increases the area available to the optical encoder 234 to sense movement of the sewing frame 186. Such a support surface 250 allows a much larger sewing frame 186 to be used and a much larger continuous area of cloth 50 to be stitched as it provides a much larger continuous area for the optical encoder 234 to sense movement of the sewing frame 186. The top of the support surface 250 and the sewing machine bed 14 may be covered with a thin adhesive covering such as vinyl or paper which provides a patterned or textured surface and allows the optical encoder 234 to easily sense movement of the sewing frame 186. Such a covering surface may also bridge any gap between the sewing machine bed 14 and the support surface 250 and provide for more accurate sensing of the optical encoder 234 as it moves across this joint.

A user may freehand stitch a desired sewing pattern into the cloth 50 by tracing along the desired sewing pattern with the sewing machine needle 214. The sewing pattern may be a printed pattern in the cloth 50, a pattern drawn onto the cloth 50, a seam pattern in the cloth 50, a pattern created in real time by the user, etc. The optical encoder 234 senses both x axis movement and y axis movement of the sewing frame 186 relative to the sewing machine bed 14 and outputs x axis movement data and y axis movement data to the stitch regulation motor controller 142 as a user moves the sewing frame 186 to sew into the cloth 50.

In use, a user moves the sewing frame 186 to stitch along the desired sewing pattern. The movement of the sewing frame 186 and cloth 50 cause the optical encoder 234 to sense the movement of the sewing frame 186 relative to the sewing machine bed 14 or surrounding table/support 250 and the motor controller 142 operates the sewing machine motor 166 to cause the sewing machine 10 to form stitches in the cloth 50. The stitch regulation motor controller 142 uses the movement data from the optical encoder 234 to vary the speed of the sewing machine motor 166 to create stitches of a user selected length as discussed above.

In an example configuration, the sewing frame processor 238 may receive movement data from the optical encoder 234. The processor 238 may also receive a user selection of stitch length from the user interface 162. The user interface 162 may be a potentiometer which allows a user to adjust the stitch length to increase or decrease the stitch length by twisting a knob and which thereby provides a variable signal to the processor 238 to indicate a stitch length selection. The processor 238 may receive power from a battery of from the sewing machine 10 via cable 246. The processor may perform the functions of the stitch regulation motor controller 142 as discussed herein and may output a signal to control the speed of the sewing machine motor 166. The cable 246 may connect to the foot pedal or foot pedal socket of the sewing machine. The processor 238 may output a signal which alters or overrides the signal produced by the foot pedal (if used with the sewing machine foot pedal) or which mimics the signal delivered to the sewing machine 10 by the foot pedal (if replacing the foot pedal) and thereby controls the speed of the sewing machine motor 166 via the foot pedal input for the sewing machine 10. Such a sewing frame 186 could work with a conventional sewing machine 10 and provide stitch length regulation without any native stitch length regulation in the sewing machine 10. All necessary components for monitoring the movement speed of the cloth 50, interfacing with the sewing machine 10, and altering the speed sewing machine motor 166 (and thereby the stitch length) may be part of the sewing frame 186. Each of the sewing frames 186 described in FIGS. 10 through 15 may be configured in this manner with processor 238, motor controller 142, or secondary processor 170 as described herein.

The configuration of the sewing frame 186 allows a large section of cloth 50 to be sewn. The size of the section of cloth 50 being sewn is limited by the throat depth of the sewing machine. This sewing system is advantageous in allowing medium quilting projects to be sewn on a sewing machine with better regulation of stitch length as user sewing speed varies. The system is also useful in allowing for stitch regulation with freehand and traced sewing and embroidery work. Significant capacity is added to a sewing machine 10 without the expense of a complex quilting frame system as shown in FIG. 1.

The optical encoders 178, 218 discussed with respect to FIGS. 9 through 15 function as described in the previous figures in that they sense x axis movement and y axis movement and output x axis movement data and y axis movement data to the stitch regulation motor controller 142. The stitch regulation motor controller 142 receives a user setting for stitch length and operates the sewing machine motor 166 at varying speeds as user sewing movement speed varies to create a more uniform stitch length according to the user selected stitch length as described herein.

The sewing systems described herein are advantageous as they provide systems which may be adapted to multiple kinds of sewing machines to provide regulated stitch length. These systems allow for more consistent stitch length and a user selected stitch length while a user traces a more complex stitching pattern. The system provides a reliable optical encoder configuration which provides accurate movement data and is resistant to dust and debris.

The above description of illustrated examples of the present invention, including what is described in the Abstract, is not intended to be exhaustive or to be limiting to the precise forms disclosed. While specific examples of the invention are described herein for illustrative purposes, various equivalent modifications are possible without departing from the broader scope of the present claims. Indeed, it is appreciated that specific example dimensions, materials, voltages, currents, frequencies, power range values, times, etc., are provided for explanation purposes and that other values may also be employed in other examples in accordance with the teachings of the present invention.

What is claimed is:

1. A sewing system for controlling the stitching speed of a sewing machine comprising:

a first optical sensor;

a first elongate cord disposed adjacent the optical sensor, the first elongate cord defining a substrate which is optically detected by the optical detector to thereby detect relative movement between the first optical encoder and the first elongate cord;

a motor controller electrically connected to the first optical sensor;

wherein the motor controller receives electrical signals from the first optical sensor which indicate relative movement between the first optical sensor and the first elongate cord;

wherein the motor controller is configured for connection to a sewing machine to thereby control operational speed of a sewing machine motor; and wherein the motor controller is configured to operate the sewing machine motor at a speed which varies according to speed of the relative movement between the first optical sensor and the first elongate cord to thereby control a length of stitch formed by the sewing machine.

2. The system of claim 1, wherein the optical sensor and the elongate cord are configured for attachment to a sewing machine quilting frame such that relative movement between a sewing machine and cloth supported by the quilting frame causes relative movement between the optical sensor and the elongate cord.

3. The system of claim 1, wherein the elongate cord is attached to a sewing machine quilting frame, wherein a sewing machine is movable relative to the quilting frame, wherein the optical sensor moves with the sewing machine to cause relative movement between the optical sensor and the elongate cord.

4. The system of claim 1, wherein the elongate cord comprises a flat textile ribbon.

5. The system of claim 1, further comprising:

a second optical sensor;

a second elongate cord disposed adjacent the optical sensor, the second elongate cord defining a substrate which is optically detected by the optical sensor to thereby detect relative movement between the second optical sensor and the second elongate cord;

wherein the motor controller is electrically connected to the second optical sensor;

wherein the motor controller receives electrical signals from the second optical sensor which indicate relative movement between the second optical sensor and the second elongate cord; and wherein the motor controller is configured to operate the sewing machine motor at a speed which varies according to a combination of speed of the relative movement between the first optical sensor and the first elongate cord and speed of the relative movement between the second optical sensor and the second elongate cord thereby control a length of stitch formed by the sewing machine.

6. The system of claim 5, wherein the first elongate cord is attached along an x axis of a sewing frame, the sewing frame configured to support a sewing machine;

wherein a cloth is attachable to the sewing frame to permit stitching the cloth via the sewing machine;

wherein the sewing machine is movable along the x axis of the sewing frame to thereby create relative movement between the first elongate cord and the first optical sensor which corresponds to x axis movement between the sewing machine and the cloth;

wherein the second elongate cord is attached along a y axis of the sewing frame; and wherein the sewing machine is movable along the y axis of the sewing frame to thereby create relative movement between the second elongate cord and the second optical sensor which corresponds to y axis movement between the sewing machine and the cloth.

7. The system of claim 1, wherein the sewing frame comprises:

a frame body;

an x axis track attached to the frame body;

a sewing machine carriage which is supported by the x axis track and which moves left and right along the x axis track;

a y axis track attached to the sewing machine carriage;

wherein the sewing machine is supported by the y axis track and which moves forwards and backwards along the y axis track;

wherein the first elongate cord is attached to the frame body and extends along a left to right length of the frame body;

wherein the first optical sensor is attached to the sewing machine carriage and is movable therewith, wherein the first optical sensor is disposed adjacent the first elongate cord, and wherein the first optical sensor senses movement relative to the first elongate cord;

wherein the second elongate cord is attached to the sewing machine carriage and extends along a forwards to backwards length of the sewing machine carriage;

wherein the second optical sensor is attached to the sewing machine and movable therewith, wherein the second optical sensor is disposed adjacent the second elongate cord, and wherein the second optical sensor senses movement relative to the second elongate cord.

8. The system of claim 7, wherein the sewing frame is configured to support a piece of fabric adjacent the sewing machine such that the sewing machine is positioned to create stitches in the fabric;

wherein the x axis track and the y axis track permit the sewing machine to move relative to the fabric to permit freehand sewing in the fabric;

wherein the first optical sensor senses movement of the sewing machine relative to the fabric in the left to right direction;

wherein the second optical sensor senses movement of the sewing machine relative to the fabric in the forwards to backwards direction; and wherein the motor controller receives x axis movement data from the first optical sensor and y axis movement data from the second optical sensor and varies the stitching speed of the sewing machine according to changes in movement speed of the sewing machine relative to the fabric to thereby create stitches in the fabric according to a user selected stitch length.

9. The system of claim 1, wherein the first optical sensor comprises an optical emitter, and an optical detector, wherein the optical detector captures images of the first elongate cord, and wherein the first optical sensor detects relative movement between the first optical sensor and the first elongate cord based on differences in subsequent captured images.

10. The system of claim 1, wherein the motor controller is connected to a user interface which is configured to receive a stitch length setting from a user, wherein the motor controller comprises a processing device which is programmed to receive movement data from the first optical sensor and calculate an operational speed for a sewing machine based on the movement data, and wherein the motor controller comprises an interface which is configured for connection to a sewing machine to thereby control operation of a sewing machine motor to control the operational speed of the sewing machine.

11. A sewing system for controlling the stitching speed of a sewing machine comprising:

a sewing frame configured to hold a piece of fabric and facilitate machine stitching in the fabric comprising:

a frame body;

a clamp for securing a piece of fabric to the frame body;

an optical sensor attached to the frame body and movable therewith, wherein the optical sensor is disposed adjacent a bottom of the frame body, and wherein the optical sensor senses movement of the frame body relative to a sewing machine in the left to right direction and senses movement of the frame body relative to the sewing machine in the forwards to backwards direction; and a sewing machine motor controller which receives x axis movement data from the x axis encoder and y axis movement data from the y axis encoder and which is configured for connection to a sewing machine and is configured to vary the stitching speed of the sewing machine according to changes in movement speed between the sewing machine and the fabric to thereby create stitches in the fabric according to a user selected stitch length.

12. The system of claim 11, further comprising a sewing machine;

a piece of fabric supported by the sewing frame adjacent the sewing machine such that the sewing machine is positioned to create stitches in the fabric;

wherein the sewing frame is movable relative to the sewing machine to permit freehand sewing in the fabric.

* * * * *